US007149466B2

(12) United States Patent
Mizumoto

(10) Patent No.: US 7,149,466 B2
(45) Date of Patent: Dec. 12, 2006

(54) CONDUCTIVE RUBBER MEMBER

(75) Inventor: Yoshihisa Mizumoto, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 34 days.

(21) Appl. No.: 11/049,736

(22) Filed: Feb. 4, 2005

(65) Prior Publication Data

US 2005/0180790 A1 Aug. 18, 2005

(30) Foreign Application Priority Data

Feb. 12, 2004 (JP) ..... 2004-034926

(51) Int. Cl.
*G03G 21/00* (2006.01)

(52) U.S. Cl. ..... 399/357; 399/176; 492/56

(58) Field of Classification Search ..... 399/357, 399/176

See application file for complete search history.

(56) References Cited

U.S. PATENT DOCUMENTS 5,619,311 A 4/1997 Kurokawa et al.
5,863,626 A * 1/1999 Yamasaki ..... 428/36.5
6,648,807 B1 * 11/2003 Hashimoto et al. ..... 492/59
2004/0106708 A1 * 6/2004 Mizumoto et al. ..... 524/242
2004/0110617 A1 * 6/2004 Mizumoto ..... 492/56

FOREIGN PATENT DOCUMENTS

JP 6-342237 A 12/1994
JP 2001-209239 A 8/2001
JP 2002-82537 A 3/2002
JP 2002278325 A * 9/2002
JP 2003287965 A * 10/2003

* cited by examiner

*Primary Examiner*—David M. Gray
*Assistant Examiner*—Ryan D. Walsh
(74) *Attorney, Agent, or Firm*—Birch, Stewart, Kolasch, and Birch, LLP

(57) ABSTRACT

A conductive rubber member having a rubber layer, disposed in an outermost layer thereof, formed by using a rubber composition containing an ionic-conductive rubber, the rubber composition further containing a dielectric loss tangent-adjusting filler. The conductive rubber member has a dielectric loss tangent of not less than 2.0 nor more than 5.0, when an alternating voltage of 5V with a frequency of 100 Hz is applied to the conductive rubber member.

8 Claims, 3 Drawing Sheets

CONDUCTIVE RUBBER MEMBER

This nonprovisional application claims priority under 35 U.S.C. § 119(a) on Patent Application No(s). 2004-034926 filed in Japan on Feb. 12, 2004, the entire contents of which are hereby incorporated by reference.

BACKGROUND OF THE INVENTION

1. Field of the Invention

The present invention relates to a conductive rubber member. More particularly, the present invention relates to a conductive rubber member suitable as a cleaning member for removing toner which has adhered to a photoreceptor and other members of an image-forming apparatus with which the toner contacts.

2. Description of the Related Art

In image-forming apparatus, researches is being widely conducted to realize a high-speed operation and to form a high-quality image and a high-quality color image. Investigations are being made to enable the image-forming apparatus to achieve such performances by improving the quality of toner. It has been revealed that the image-forming apparatus is capable of achieving the above-described performances by reducing the diameter of the toner from 10 μm, conventionally, adopted to as small as 5 μm. Thus research for reducing the diameter of the toner is being conducted energetically and widely.

However, toner having a small diameter of 5 μm is liable to readily adhere to itself. In addition, it is difficult to remove the toner that has adhered to a member such as a photoreceptor of an image-forming apparatus. An external additive is added to the toner to prevent it from adhering to itself. However, not only the toner but also the external additive adheres to the photoreceptor and other members of the image-forming apparatus. The most serious problem in the image-forming apparatus is the adhesion of the toner and the external additive to the photoreceptor and other members with which the toner contacts, as described above.

The toner and the external additive are electrostatically transported from a developing roller to the photoreceptor of the image-forming apparatus. The toner and the external additive are transported from the photoreceptor to paper or an intermediate medium in a transfer process. In the transfer process, the toner and the external additive are not completely transferred from the photoreceptor to the paper or the intermediate medium, but actually a part of the toner and the external additive remain adhered to the photoreceptor. Thus it is necessary to perform a cleaning process. However, when the diameter of the toner is as small as 5 μm, it is very difficult to completely remove the toner and the external additive from the photoreceptor in the cleaning process. Consequently in a charging process to be performed after the cleaning process, a conductive member such as a charging roller is stained by the toner and the external additive which have not been completely removed in the cleaning process. Consequently defective charging occurs or the conductive member is damaged, which gives rise to a serious influence on the reliability of the image-forming apparatus.

A blade is used widely in the cleaning process to scrape the toner and the external additive from the surface of the photoreceptor and the like. The scraped toner and external additive are collected to a toner collection box. This mechanism necessitates the image-forming apparatus to be provided with a complicated mechanism for transporting the scraped toner and external additive to the toner collection box. As such it is difficult to recycle the toner. In this mechanism, because a cleaning operation is performed with only the blade, it is necessary to scrape the toner and the external additive by applying a very high pressure thereto. This causes the toner to deteriorate to a large extent. Even though the toner can be recycled in this mechanism, the toner is incapable of maintaining sufficient chargeability.

In the image-forming apparatus, there is a demand for a higher-speed operation and higher-quality image and color image, improvement in reliability and, in addition, energy-saving by recycling or reusing the toner. In compliance with these demands, development of a novel cleaning mechanism and members preventing deterioration of the toner has been urgent.

A roller-charging apparatus was proposed as a cleaning mechanism to comply with the above-described demand, as disclosed in Japanese Patent Application Laid-Open No. 6-342237 (patent document 1). The cleaning mechanism includes a contact-type charging roller and a cleaning blade mounted on the charging roller under pressure, for removing foreign substances such as the toner which is adhered to the surface of the charging roller. However, as disclosed in the description of "Examples" in the specification, the surface of the charging roller is coated with a polyamide resin or a fluorocarbon resin. Thus toner which has been collected from the charging roller is not destaticized and may be charged to a greater extent, which necessitates the cleaning blade to be mounted on the charging roller at a higher pressure. Consequently the toner tends to deteriorate. In addition, the coating material formed on the surface of the charging roller becomes worn by repeated use of the charging roller. As a result, the initials, favorable chargeability cannot be maintained and the foreign substance such as the toner is removed at a low efficiency.

The cleaning means is disclosed in Japanese Patent Application Laid-Open No. 2001-209239 (patent document 2). The cleaning means includes an elastic member, having a polarity opposite to that of toner, which is in contact with the charging roller and the magnet proximate to the elastic member and not in contact with the charging roller. In the cleaning means, the toner which has adhered to the charging roller is scraped by the elastic member and collected by the magnet. The cleaning means is effective for removing a magnetic toner from the charging roller but insufficient in removing a nonmagnetic toner and the external additive which have adhered to the charging roller. Consequently the external additive and the unmagnetic toner remain on the charging roller. Thus the cleaning means cannot be reliably used for a long time.

The cleaning apparatus disclosed in Japanese Patent Application Laid-Open No. 2002-82537 (patent document 3) cleans a liquid developer which remains on the intermediate transfer body. The cleaning apparatus is effective for an image-forming apparatus using the liquid developer, but is not nonapplicable to an image-forming apparatus using a dry developer nor has a mechanism in which recycling of the developer is considered.

SUMMARY OF THE INVENTION

The present invention has been made in view of the above-described problems. Therefore it is an object of the present invention to provide a conductive rubber member that is used suitably as a cleaning roller capable of removing toner and an external additive which have adhered to a surface of a member such as a photoreceptor of an image-forming apparatus and suppressing the deterioration of the toner to a large extent in removing the toner from the photoreceptor and other members.

To achieve the above-described object, the present invention provides a conductive rubber member having a rubber layer, disposed in an outermost layer thereof, and composed of a rubber composition containing an ionic-conductive rubber. The rubber composition further contains a filler for adjusting the dielectric loss tangent of the conductive rubber member to be not less than 2.0 nor more than 5.0, when an alternating voltage of 5V with a frequency of 100 Hz is applied to the conductive rubber member.

The present inventors, through repeated research and experimentation have acquired the knowledge that charged toner and external additives which have adhered to the conductive rubber member used as a cleaning roller, a charging roller with cleaning function, a cleaning blade, and so on, are destaticized and thus the charged amount thereof is reduced by setting the dielectric loss tangent of the conductive rubber member to not less than 2.0 nor more than 5.0, measured under the above-described condition. The destaticized toner and external additive can be removed easily from the conductive rubber member by a blade or the like without applying any mechanical stress, such as high pressure thereto. Thus deterioration of the toner can be suppressed to a large extent in the toner removal operation.

In the present invention, the dielectric loss tangent of the conductive rubber member used as a cleaning roller, a charging roller with a cleaning function, a cleaning blade and so on is set to not less than 2.0 nor more than 5.0 measured under the above-described condition. The conductive rubber member is brought into contact with the photoreceptor and other members with which the toner and the external additive contacts to transfer thereto all or at least one portion of the toner and the external additive which have adhered to the photoreceptor and the other members. Thereby, the toner and the external additive can be efficiently destaticized and removed easily from the photoreceptor or the like. As a measuring condition for measurement of the dielectric loss tangent, a slight voltage of 5V is applied to the conductive rubber member, because an extremely slight change of voltage takes place when toner adheres to the conductive rubber member or when toner is transported to the photoreceptor. In addition, a frequency is set to 100 Hz because a low frequency substantially matches with the situation.

As described above, in the present invention, the dielectric loss tangent of the rubber layer constituting the outermost layer of the conductive rubber member is advantageously set to be not less than 2.0 nor more than 5.0 and more favorably not less than 2.0 nor more than 4.0, and most favorably not less than 2.0 nor more than 3.0, measured under the condition that an alternating voltage of 5V with a frequency of 100 Hz is applied to the conductive rubber member.

The dielectric loss tangent is an index indicating the flowability of electricity (conductivity) and an influence degree of a capacitor component (electrostatic capacity). The dielectric loss tangent is a parameter showing a phase delay when alternating current is applied to the conductive rubber member. The dielectric loss tangent is computed as tangent (electrostatic capacity/conductivity).

More specifically, the dielectric loss tangent is an index for measuring the degree of an electric charge which can be held by the charged toner and external additive, when they adhere to the conductive rubber member of the present invention. When the dielectric loss tangent is in the above-described range, the charged amount of the charged toner and external additive can be efficiently decreased to thereby destaticize them after an elapse of a predetermined period of time. More specifically, the dielectric loss tangent is so set that the charged amount of the toner which has adhered to the conductive rubber roller is not more than 10 μC/g after an elapse of five minutes.

The reason the dielectric loss tangent of the conductive rubber member is set to the above-described range is as follows: If the dielectric loss tangent is set to less than 2.0, the charged amount of the toner and the external additive does not decrease and thus the destaticizing performance of the conductive rubber member is inferior. If the dielectric loss tangent of the conductive rubber member is set to more than 5.0, it is necessary to use an excessively large amount of the dielectric loss tangent-adjusting filler for the rubber component, which makes it difficult to obtain a sufficient rubber elasticity.

To adjust the dielectric loss tangent of the rubber layer constituting the outermost layer of the conductive rubber member to the above-described range, the rubber composition constructing the outermost rubber layer of the conductive rubber member contains the dielectric loss tangent-adjusting filler.

As the dielectric loss tangent-adjusting filler, a hydrous aluminum silicate compound, calcium carbonate or organic and inorganic pigments can be used. Above all, the hydrous aluminum silicate compound can be preferably used, because the dielectric loss tangent can be adjusted to not less than 2.0 by adding a small amount thereof to the rubber component. A mixture of the hydrous aluminum silicate compound and the calcium carbonate can be used as the dielectric loss tangent-adjusting filler.

A compound indicated by $Al_2O_3.xSiO_2.yH_2O$ (x and y show integers not less than 1) can be favorably used as the hydrous aluminum silicate compound. Above all, compounds in which (x, y) is (2, 2), (2, 4) or (4, 1) are more favorable. A compound indicated by $Al_2O_3.2SiO_2.2H_2O$ can be most favorably used as the hydrous aluminum silicate compound. As the molecular structure of these compounds, a two-octahedron type 1:1 layer structure is particularly preferable.

Natural minerals such as kaolin and clay can be listed as the hydrous aluminum silicate compound. Above all, kaolin minerals such as kaolinite, dickite, and nacrite are preferable.

Hard clay having a small particle diameter and a high reinforcing performance is particularly preferable. Hard clay baked to decrease its water content is particularly preferable because the conductive rubber member has a uniform electrical characteristic.

The mixing amount of the dielectric loss tangent-adjusting filler is different according to the kind thereof, provided that the mixing amount thereof allows the rubber layer constituting the outermost layer of the conductive rubber member to have the dielectric loss tangent within the above-described range. For example, when the hydrous aluminum silicate compound and/or the calcium carbonate are used as the dielectric loss tangent-adjusting filler, the mixing amount thereof is favorably not less than 2 parts by mass and more favorably 5 to 100 parts by mass for 100 parts by mass of the rubber component.

The rubber composition composing the rubber layer constituting the outermost layer of the conductive rubber member contains the ionic-conductive rubber as its main component. The content of the ionic-conductive rubber is favorably not less than 30 parts by mass, more favorably not less than 50 parts by mass, and most favorably not less than 70 parts by mass for 100 parts by mass of the rubber composition.

As the ionic-conductive rubber, various kinds of unsaturated rubbers or thermoplastic rubbers are available. These rubbers can be used as copolymer rubber, blended rubber, and the like. More specifically, it is possible to use epihalohydrin rubber (particularly, epichlorohydrin rubber), acrylonitrile rubber, acrylonitrile butadiene rubber, chloroprene rubber, butadiene rubber, styrene butadiene rubber, butyl rubber, fluororubber, isoprene rubber, urethane rubber, and silicone rubber. These rubbers can be used singly or in combination.

As the ionic-conductive rubber, polar rubber and halogen-containing rubber are preferable. As the halogen-containing rubber, epichlorohydrin rubber and epichlorohydrin polymer are preferable. More specifically, it is possible to use epichlorohydrin (EP) homopolymerized rubber, epichlorohydrin-ethylene oxide (EO) copolymer, epichlorohydrin-propylene oxide (PO) copolymer, epichlorohydrin-allyl glycidyl ether (AGE) copolymer, epichlorohydrin-ethylene oxide-allyl glycidyl ether copolymer, epichlorohydrin-propylene oxide-allyl glycidyl ether copolymer, epichlorohydrin-ethylene oxide-propylene oxide-allyl glycidyl ether copolymer.

The epichlorohydrin rubber which is one of the halogen-containing rubbers may be combined with other rubber components. It is preferable to add not less than 20 parts by mass nor more than 100 parts by mass to an entire rubber component. Thereby a preferable oxide film can be formed.

To control the dielectric loss tangent of the conductive rubber member, the rubber composition composing the rubber layer constituting the outermost layer of the conductive rubber member may contain a conductive agent in addition to the ionic-conductive rubber. As the conductive agent, it is possible to use known carbon black such as ketchen black, furnace black, acetylene black; conductive metal oxides such as zinc oxide, potassium titanate, antimony-doped titanium oxide, tin oxide, and graphite; metal salts such as $LiClO_4$, $LiCF_3SO_3$, $NaClO_4$, $LiAsF_6$, $LiBF_4$, NaSCN, KSCN, and NaCl; and electrolytes such as quaternary ammonium salts and phosphate.

It is particularly favorable to add carbon black having a weak conductivity to the rubber component of the conductive rubber member of the present invention. The mixing amount of the carbon black is different according to the kind thereof. The mixing amount of the carbon black is 0.5 to 20 parts by mass, favorably 1 to 10 parts by mass, and more favorably 1 to 4 parts by mass for 100 parts by mass of the rubber component.

The rubber composition composing rubber layer constituting the outermost layer of the conductive rubber member may contain additives such as a vulcanizing agent, a processing aid, a plasticizer, an acid-accepting agent, and a deterioration inhibitor. The total amount of these additives is favorably 30 to 70 parts by mass for 100 parts by mass of the rubber component. The reason the total amount of these additives is set to not less than 30 is to improve processing accuracy by efficiently adjusting the dielectric loss tangent and improving abrasive property (processability). The reason the total amount of these additives is set to not more than 70 is to prevent a rise of the hardness of the conductive rubber member so that members that contact the conductive rubber member are not damaged.

Vulcanizing agents containing sulfur, triazine derivatives, thioureas, and monomers can be used. These vulcanizing agents can be used singly or in combination. As the sulfur vulcanizing agent, it is possible to use organic sulfur-containing compounds such as powder sulfur, tetramethylthiuram disulfide, and N,N-dithiobismorpholine. As the thiourea vulcanizing agents, it is possible to use one or a plurality of thioureas selected from among tetramethylthiourea, trimethylthiourea, ethylenethiourea, and thioureas indicated by (CnH2n+1NH) 2C═S (n indicates integers 1 through 10).

The mixing amount of the vulcanizing agent is 0.5 to 5 parts by mass and favorably 1 to 3 parts by mass for 100 parts by mass of the rubber component.

Rubber obtained by vulcanizing the epichlorohydrin rubber or the epichlorohydrin polymer with the thiourea vulcanizing agent and in particular with the ethylene thiourea can be particularly preferably used in the present invention because the rubber has a compression set not more than 15% and hence has preferable durability, can be polished with high accuracy, and has an oxide film-forming effect by utilizing ultraviolet rays. In this case, the thiourea-containing vulcanizing agent is added to 100 parts by mass of the rubber component at not less than 0.2 parts by mass nor more than 3 parts by mass and favorably at not less than 1 part by mass nor more than 2 parts by mass. It is preferable to use powder sulfur in combination with the thiourea-containing vulcanizing agent. In this case, the addition amount of the powder sulfur is 0.1 parts by mass to 1.0 part by mass for 100 parts by mass of the rubber component.

As the plasticizer, in addition to dibutyl phthalate (DBP), dioctyl phthalate (DOP), and tricresyl phosphate, a large number of substances used as the conductive agent and the processing aid contain a plasticizing component. For example, fatty acids such as stearic acid used as the processing aid and quaternary ammonium salts used as the ionic-conductive agent can be used as the plasticizer. It is preferable to add less than 5 parts by mass of the plasticizing component to 100 parts by mass of the rubber component of the rubber layer to prevent generation of bleed when the oxide film is formed and prevent stain of the photoreceptor when the conductive rubber member is mounted on a printer or the printer is in operation.

As the above-described acid-accepting agent, it is preferable to use hydrotalcites and magsarat because they are superior in dispersibility. As the acid-accepting agent, substances acting as a acid acceptor can be used. As the rubber component, the halogen-containing rubber is preferably used. When the epichlorohydrin rubber or the epichlorohydrin polymer is used, the acid-accepting agent is added thereto at favorably not less than 1 part by mass nor more than 10 parts by mass and more favorably not less than 1 part by mass nor more than 5 parts by mass for 100 parts by mass of the epichlorohydrin rubber or the epichlorohydrin polymer. The addition amount of the acid-accepting agent is preferably not less than 1 part by mass to prevent vulcanization from being inhibited and the photoreceptor from being stained. To prevent a rise of the hardness of the rubber layer, the addition amount of the acid-accepting agent is preferably not more than 10 parts by mass.

As the above-described deterioration inhibitor, various age resisters can be used. As the age resister, various antioxidants can be used. When the age resister is used, it is preferable to appropriately select the addition amount thereof as desired to efficiently proceed the formation of the oxide film at the surface.

It is preferable that an oxide film is formed on a surface of the rubber layer constituting the outermost layer of the conductive rubber member of the present invention. The oxide film can be effectively used to adjust the dielectric loss tangent, make the hardness of the surface high, decrease the friction coefficient of the surface of the rubber layer, and allows destaticized toner to be collected without mechanically imparting a stress thereto. Further the oxide film is capable of enhancing the wear resistance of the rubber layer.

It is preferable that the oxide film has a large number of C═O groups or C—O groups. The oxide film can be formed by irradiating the surface of the rubber layer with ultraviolet rays or/and ozone and oxidizing the surface of the rubber layer. It is preferable to form the oxide film by irradiating the surface of the rubber layer with ultraviolet rays because the use of the ultraviolet rays shortens the treating period of time and makes the cost less expensive. The treatment for forming the oxide film can be accomplished by a known method. It is preferable to irradiate the surface of the rubber layer with ultraviolet rays having a wavelength of 100 nm to 400 nm and favorably 100 nm to 200 nm for 3 to 30 minutes, although the wavelength and the irradiation period of time are different according to the distance between the surface of the rubber layer and an ultraviolet ray lamp and the kind of rubber.

It is preferable that the oxide film has a thickness of 1 μm to 20 μm and favorably 3 μm to 15 μm.

The rubber layer not irradiated with the ultraviolet rays is preferable in improving the dielectric loss tangent of the conductive rubber member when the image-forming apparatus is so constructed that the conductive rubber member does not contact members to be cleaned.

Supposing that an electric resistance at an applied voltage of 50V before an oxide film is formed is R50 and an electric resistance at an applied voltage of 50V after the oxide film is formed is R50*a*, it is preferable that log R50*a*−log R50=0.2 to 1.5 to improve the durability of the conductive rubber member and reduce a stress to be applied to toner.

Supposing that in the conductive rubber member of the present invention, an electric resistance at an applied voltage of 500V is R500 and an electric resistance at an applied voltage of 100V is R100, it is preferable that (log R100−log R500)<0.5. That is, the dependence of the conductive rubber member on voltage is evaluated by using the difference between an electric resistance value when 100V is applied thereto and a reference electric resistance value when 500V close to a developing bias is applied thereto as an index. Thereby the uniformity of the electric characteristic of the conductive rubber roller can be clarified. It is preferable that the value of the equation is less than 0.5 to reduce the dependence of the conductive rubber member on voltage.

The conductive rubber member of the present invention is not limited to a specific use but can be used for applications demanding destaticizing performance.

It is preferable to use the conductive rubber member of the present invention as a cleaning member for the image-forming apparatus. It is possible to use the conductive rubber member of the present invention as the cleaning member for a member such as the photoreceptor with which toner contacts and a member (for example, charging roller) to which toner may be transferred. More specifically, the conductive rubber member of the present invention can be used as a cleaning roller for removing foreign substances such as the toner, the external additive, and paper powder which have remained on the photoreceptor, after a toner image formed on the photoreceptor is transferred to media (for example, paper or intermediate transfer belt). A high-quality image can be formed by enhancing the cleaning performance of the conductive rubber member.

The photoreceptor or the like can be cleaned more efficiently by combining the conductive rubber member with the blade. As a mode, it is possible to exemplify a cleaning apparatus having the roller-shaped conductive rubber member of the present invention and the blade mounted thereon in contact with the surface of the conductive rubber member.

In the cleaning apparatus, the conductive rubber member of the present invention is brought into contact with members such as the photoreceptor, the charging roller, and the like to be cleaned so that foreign substances such as the toner, the external additive, and the paper powder which have adhered to the members to be cleaned adhere to the conductive rubber member of the present invention and foreign substances which have adhered to the conductive rubber member are destaticized. Thereafter the foreign substances are removed from the photoreceptor and the like by the blade mounted thereon in contact with the surface of the conductive rubber member.

It is possible to install the conductive rubber member of the present invention on the image-forming apparatus as a charging roller serving as the cleaning roller by providing the conductive rubber member with a function of the charging roller.

A voltage is applied to the charging roller while it is being driven by the photoreceptor with which the charging roller is in contact. Thereby the charging roller discharges in a very small gap between the charging roller and the photoreceptor, thus charging the surface of the photoreceptor. Therefore to use the conductive rubber member of the present invention as the charging roller, the conductive rubber member should be provided with performance of charging the photoreceptor uniformly and leakage-resistant performance of preventing electric current from being collectively applied to a pin hole (micro-defect such as hole having very small diameter) when the pin hole is formed on the photoreceptor. To do so, known means can be used. For example, the electric resistance value of the conductive rubber member should be adjusted to $10^6$ to $10^9$ Ωcm of the electric resistance value of a semi-conductive region or the JIS A hardness thereof is set to 35 to 45.

Provided that the conductive rubber member has the conductive rubber layer at its outermost layer, the conductive rubber member is not demanded to have a specific construction, but may have a plurality of layers, for example, two layers in dependence on the content of demanded performance. However, it is preferable that the conductive rubber layer has a one-layer construction because the conductive rubber member having the one-layer construction has little variations in its properties and can be produced at a low cost. The conductive rubber member is not demanded to have a specific configuration, but may be roller-shaped or plate-shaped in dependence on a state in which it is used.

The conductive rubber member of the present invention is capable of destaticizing the charged toner, the external additive added to the toner or the paper powder which has adhered to the photoreceptor and the like. The destaticized toner, external additive or paper powder can be easily removed from the photoreceptor and the like by scraping them from the photoreceptor and the like with a blade without using a high pressure unlike the conventional art in which the toner and the like are removed by means of only the blade. Consequently it is possible to reduce a mechanical stress to be applied to the toner in a cleaning operation and suppress deterioration of the toner to a high extent. Thereby the conductive rubber member allows the toner to be recycled and contributes to energy-saving.

By using the conductive rubber member of the present invention as the cleaning member or using the cleaning member including the conductive rubber member of the present invention combined with the blade, foreign substances such as the toner, the external additive or the paper powder which remain on the photoreceptor or the like decreases. Therefore it is possible to prevent the foreign substances from staining a charging member such as a charging roller. Consequently it is possible to prevent the photoreceptor or the like from being charged defectively and the charging member from being damaged. Thereby it is possible to improve the reliability on the image-forming apparatus and enhance the performance of forming a high-quality image.

DETAILED DESCRIPTION OF THE PREFERRED EMBODIMENTS

The embodiments of the conductive rubber member of the present invention will be described below. In the embodiment described below, the conductive rubber member is used as a cleaning roller.

Figure 1:
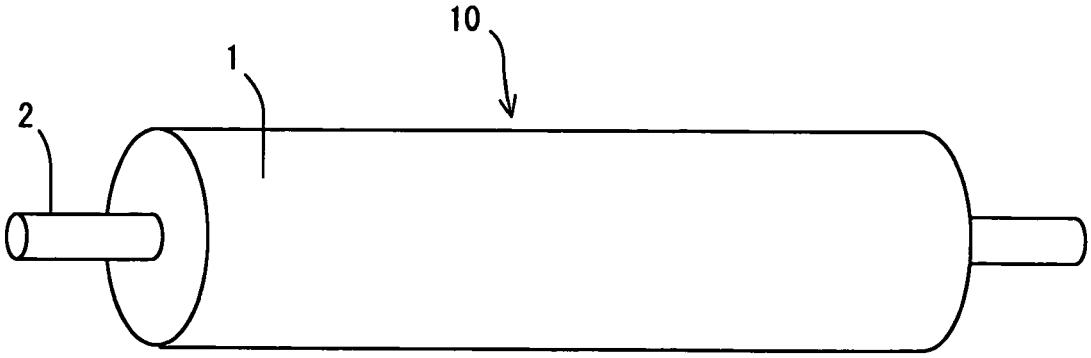
FIG. 1 is a schematic view showing a roller-shaped conductive rubber member of the present invention.

As shown in FIG. 1, a conductive rubber roller 10 has a cylindrical rubber layer 1 and a columnar metal core (shaft) 2 inserted into a hollow portion of the rubber layer 1 by press fit and bonded thereto with a conductive adhesive agent.

In this embodiment, the thickness of the rubber layer 1 is set to 6 mm. The metal core 2 inserted into the hollow portion of the rubber layer 1 by press fit and bonded thereto with the conductive adhesive agent has a diameter of 10 mm.

The thickness of the rubber layer 1 is 0.5 mm to 10 mm and favorably 1 mm to 7 mm.

The surface of the rubber layer 1 is oxidized with ultraviolet rays to form an oxide film on the surface.

The rubber layer 1 is composed of a rubber composition containing the ionic-conductive rubber as its main component. More specifically, the rubber component is a copolymerizate of 56 mol % of ethylene oxide (EO), 40 mol % of epichlorohydrin (EP), and 4 mol % of allyl glycidyl ether (AGE). The rubber composition contains 30 to 40 parts by mass of clay (hydrous aluminum silicate compound) as a dielectric loss tangent-adjusting filler dispersed therein for 100 parts by mass of the rubber component. The rubber composition further contains 0.5 parts by mass of sulfur powder as its vulcanizing agent, 1.4 parts by mass of thiourea as its vulcanizing accelerating agent, 3 parts by mass of hydrotalcite as its acid-accepting agent, and 2 parts by mass of conductive carbon black as its conductive agent for 100 parts by mass of the rubber component.

The conductive rubber roller 10 is manufactured by the following method:

After the rubber composition containing the above-described components copolymerized at the above-described ratios is kneaded, it is preformed by extruding it cylindrically from an extruder. The extruded rubber composition is cut to a predetermined size to obtain a preform. Thereafter the preform is supplied to a vulcanizing can to vulcanize it at a temperature at which the rubber component is crosslinked. The vulcanizing condition is appropriately selected. But it is preferable to vulcanize the preform at 160° C. for one hour. Thereafter a core metal is inserted into the cylindrical rubber layer.

An oxide film may be formed on the surface of the conductive rubber layer constituting the outermost layer of the conductive rubber roller 10, as desired. The above-described oxide film can be formed by carrying out the following method:

The surface of the rubber roller is polished by a cylindrical polishing machine to a mirror-like surface finish to set the surface roughness Rz of the rubber roller to not more than 6.5 μm and favorably 3 to 5 μm. After the surface of the rubber roller is washed with water, an ultraviolet ray irradiator irradiates the surface of the rubber roller with ultraviolet rays (184.9 nm) to form an oxidized film.

More specifically, the rubber roller is irradiated with ultraviolet rays at intervals of 90 degrees in the circumferential direction thereof for favorably 1 to 15 minutes and more favorably 5 to 10. The rubber roller is rotated at 90 degrees four times in its circumferential direction to form the oxide film on the entire peripheral surface thereof.

The dielectric loss tangent of the conductive rubber roller 10 of the present invention obtained in the above-described method is adjusted to not less than 2.0 nor more than 5.0.

Supposing that the electric resistance of the conductive rubber roller 10 is R100 when a voltage of 100V is applied thereto and is R500 when a voltage of 500V is applied thereto, the value of log R100−log R500 is less than 0.5.

By setting the electric resistance value of the conductive rubber roller 10 to the above-described range, it is possible to transfer a large amount of toner remaining on the photoreceptor to the surface of the conductive rubber roller 10.

By setting the electric resistance value of the conductive rubber roller 10 to the above-described range, it is possible to transfer the toner which has remained on the photoreceptor to the surface of the conductive rubber roller 10.

It is preferable that as the index of the destaticizing effect, the charged amount of toner which has adhered to the conductive rubber roller 10 is not more than 10 μC/g after elapse of five minutes. By reducing the charged amount of the toner to destaticize the toner, it is easy to remove the toner which has been transferred from the photoreceptor or the like to the surface of the conductive rubber roller 10.

The charged amount of the toner which has adhered to the conductive rubber roller 10 is measured by a method described below in the examples.

Figure 2:
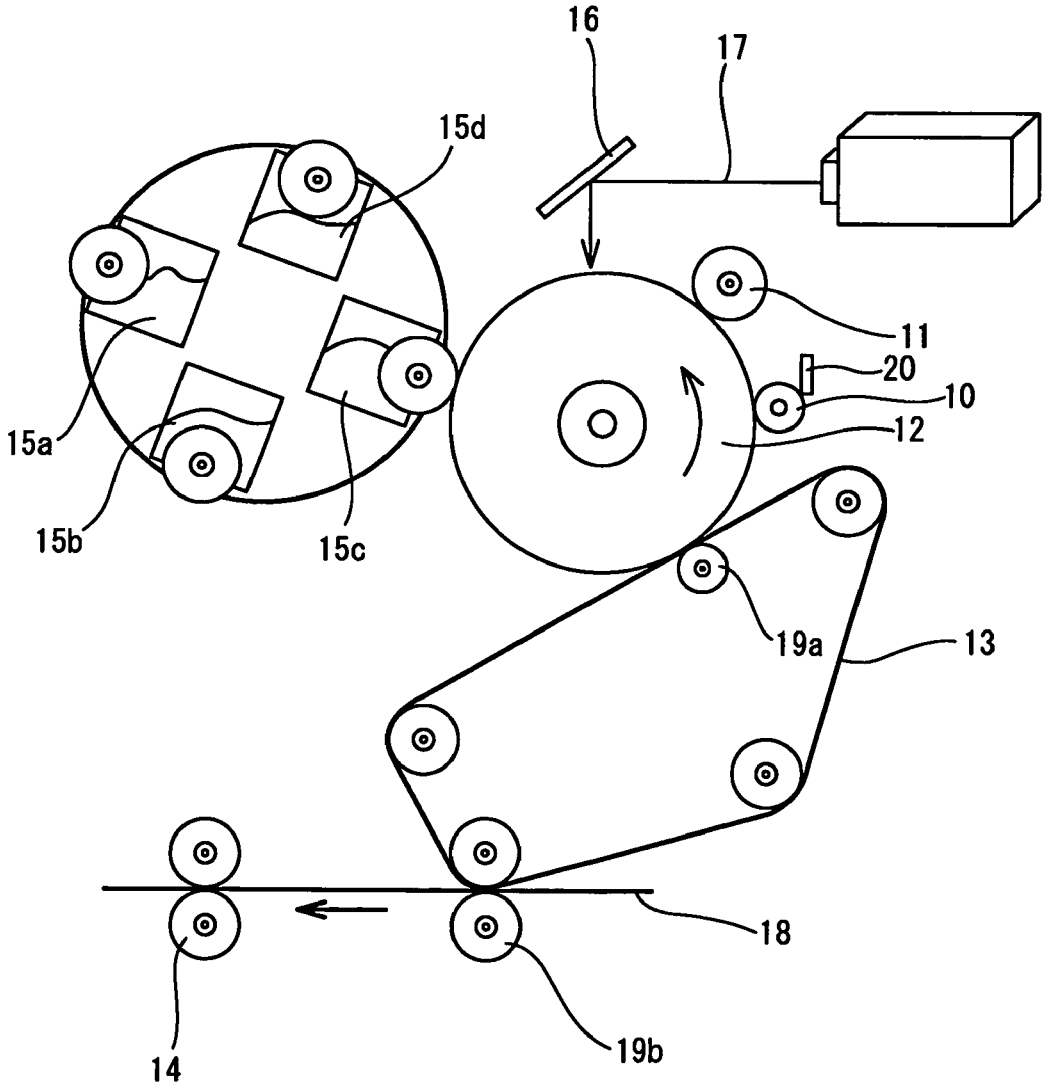
FIG. 2 is an illustrative view showing a color image-forming apparatus in which the conductive rubber member of the present invention is mounted as a cleaning member for a photoreceptor.

FIG. 2 shows an embodiment in which the conductive rubber roller 10 of the present invention is mounted on a color image-forming apparatus as a cleaning roller for a photoreceptor thereof.

The color image-forming apparatus has a photoreceptor 12, the conductive rubber roller 10 used as a cleaning member for the photoreceptor 12, a blade 20, a charging roller 11, an intermediate transfer belt 13, a fixing roller 14, toner 15 in four colors (15*a*, 15*b*, 15*c*, and 15*d*), a mirror 16, and transfer rollers 19*a* and 19*b*.

As the operation mechanism of the color image-forming apparatus, initially, the photoreceptor 12 rotates in the direction shown with an arrow of FIG. 2. After the photoreceptor 12 is charged by the charging roller 11, a laser 17 exposes a non-imaging portion of the photoreceptor 12 via the mirror 16. As a result, the non-imaging portion is destaticized. The portion of the photoreceptor 12 corresponding to an imaging portion is charged. Thereafter the toner 15*a* is supplied to the photoreceptor 12 and adheres to the charged imaging portion to form a first-color toner image. An electric field is applied to the primary transfer roller 19*a* to transfer the toner image to the intermediate transfer belt 13. Toner which has not been transferred to the intermediate transfer belt 13 but remained on the photoreceptor 12 adheres to the conductive rubber roller 10, destaticized thereby, is easily removed from the photoreceptor 12 by the blade 20 kept in contact with the conductive rubber roller 10 under pressure, and collected in a toner collection box (not shown). In the same manner, a toner image of each of the other toners 15*b* to 15*d* formed on the photoreceptor 12 is transferred to the intermediate transfer belt 13. A full-color image composed of the toner 15 (15*a* through 15*d*) in four colors is formed on the intermediate transfer belt 13. An electric field is applied to the secondary transfer roller 19*b* to transfer the full-color image to paper 18. When the paper 18 passes between a pair of the fixing rollers 14 heated to a predetermined temperature, the full-color image is transferred to the surface of the paper 18. In performing double-side printing, the paper 18 that has passed the fixing roller 14 is inverted inside the printer. Then the above-described image-forming processes are repeated. Thereby an image is formed on the rear surface of the paper 18.

Figure 3:
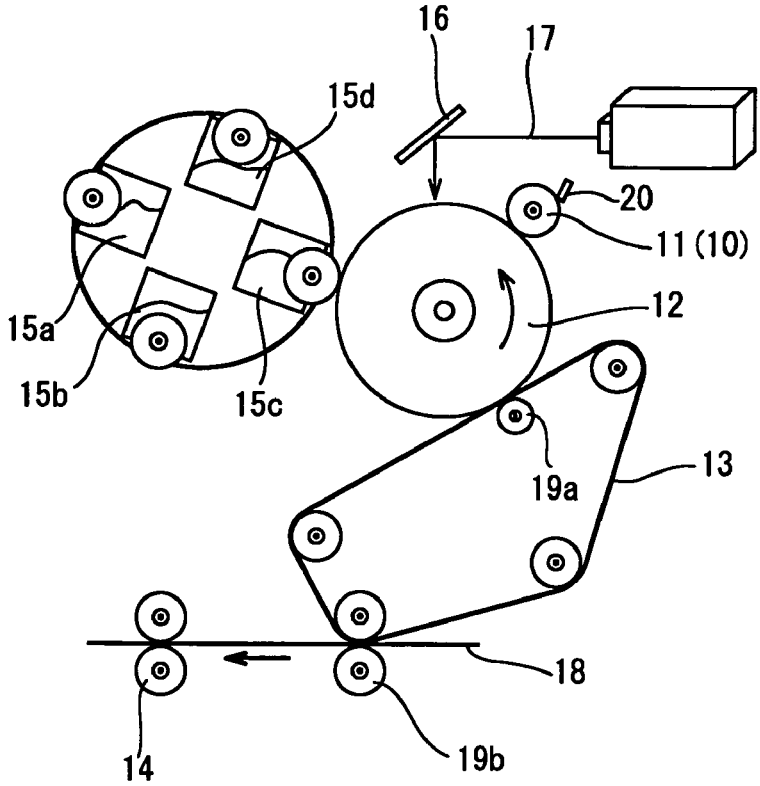
FIG. 3 is an illustration showing a color image-forming apparatus in which the conductive rubber roller of the present invention provided with the function of a charging roller is mounted as the charging roller.

FIG. 3 shows an embodiment in which the conductive rubber roller 10 of the present invention is mounted on the color image-forming apparatus as the charging roller 11.

The conductive rubber roller 10 is mounted on the color image-forming apparatus with the conductive rubber roller 10 kept in contact with the photoreceptor 12 so that the conductive rubber roller 10 is driven by the photoreceptor 12. The conductive rubber roller 10 charges the photoreceptor 12. At the same time, toner which has not been transferred to the intermediate transfer belt 13 and adhered to the photoreceptor 12 adheres to the conductive rubber roller 10 and is destaticized. The destaticized toner is easily removed from the conductive rubber roller 10 by the blade 20 kept in contact with the conductive rubber roller 10 under pressure and collected in a collection box (not shown).

Other mechanisms of the color image-forming apparatus are as described above with reference to FIG. 2.

Figure 4:
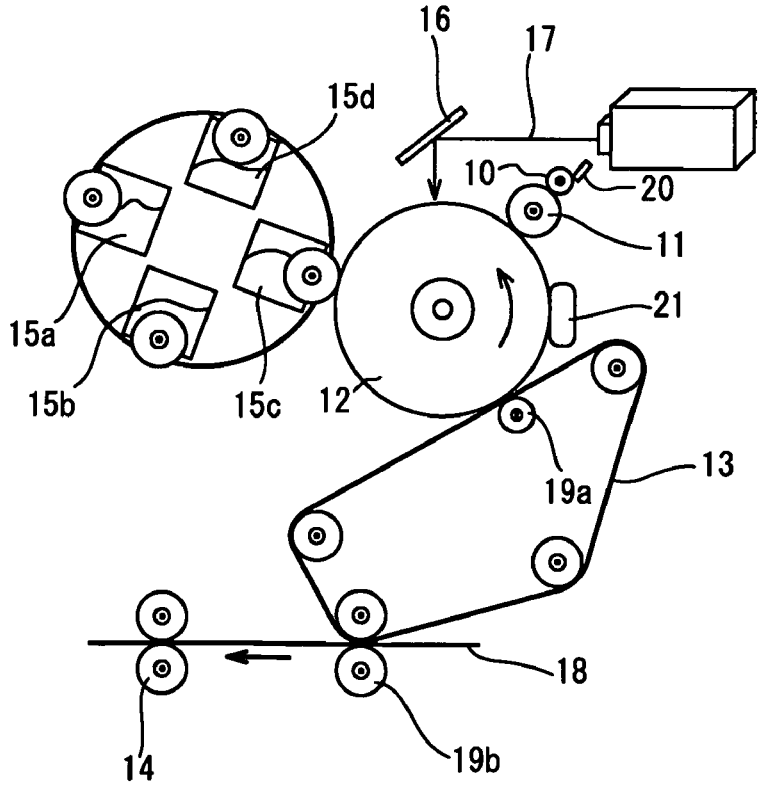
FIG. 4 is an illustrative view showing the color image-forming apparatus in which the conductive rubber member of the present invention is mounted as a cleaning member for the charging roller.

FIG. 4 shows an embodiment in which the conductive rubber member 10 of the present invention is mounted on the color image-forming apparatus as a cleaning member for a charging roller.

The above-described image-forming apparatus has a known cleaner 21 for the photoreceptor 12. Toner which has not been transferred to the intermediate transfer belt 13 and remained on the photoreceptor 12 is removed by the cleaner 21. However, as described above, the toner and the external additive are not completely removed from the photoreceptor 12 and remain thereon and attach to the charging roller. After the toner and the external additive which have adhered to the charging roller are adhered to the conductive rubber roller 10, the toner is destaticized and removed by the blade 20 kept in contact with the conductive rubber roller 10 under pressure. Other mechanisms of the color image-forming apparatus are as described above with reference to FIG. 2.

The conductive rubber rollers of examples 1 and 2 of the present invention and those of comparison examples 1 and 2 were formed to measure the dielectric loss tangent thereof, the electric resistance thereof, the charged amount of toner, and the cleaning performance thereof. Materials for the conductive rubber rollers of the examples and the comparison examples and the method of forming them are as shown in table 1.

The conductive rubber roller of each of the examples 1 and 2 and the comparison examples 1 and 2 was formed as follows: Components shown in table 1 and described below were kneaded by a Banbury mixer. Thereafter the kneaded components were extruded from an extruder to obtain a tube having an outer diameter of ϕ20 mm and an inner diameter of ϕ9.3 mm. The tube was mounted on a shaft for vulcanizing use. After the rubber component was vulcanized by a vulcanizing can at 160° C. for one hour, the tube was mounted on a shaft, having a diameter of ϕ10 mm, to which a conductive adhesive agent was applied. The tube and the shaft were bonded to each other in an oven at a temperature of 160° C. After the end of each of the obtained tube was shaped, the surface thereof was polished by traverse polishing and finish polishing to a mirror-like surface finish by using a cylindrical polishing machine so that the diameter of the tube was ϕ16 mm (tolerance: 0.05) and had a predetermined surface roughness. The surface roughness Rz of the obtained conductive rubber roller was 3 to 5 μm. The surface roughness Rz was measured in accordance with JIS B 0601 (1994).

After the surface of each conductive rubber roller was washed with water, the surface thereof was irradiated with ultraviolet rays to form an oxidized layer on the surface thereof by using an ultraviolet ray irradiator ("PL21-200" produced by Sen Tokushu Kogen Inc). The rubber roller was irradiated with ultraviolet rays (184.9 nm) at intervals of 90 degrees in its circumferential direction for a predetermined period of time by spacing the ultraviolet ray irradiator by 10 cm from the rubber roller. The rubber roller was rotated by 90 degrees four times to form the oxide film on its entire peripheral surface (360 degrees). The irradiation period of times shown in table 1 is the period of time spent to irradiate ¼ (range of 90 degrees) of the entire peripheral surface of the rubber roller.

TABLE 1

| | Example 1 | Example 2 | Comparison example 1 | Comparison example 2 |
|---|---|---|---|---|
| Epichlorohydrin rubber | 100 | 100 | 100 | 100 |
| Powder sulfur | 0.5 | 0.5 | 0.5 | 0.5 |
| Ethylene thiourea | 1.4 | 1.4 | 1.4 | 1.4 |
| Hydrotalcite | 3 | 3 | 3 | 3 |
| Hydrous aluminum silicate compound | 10 | 40 | | |
| Calcium carbonate | 20 | | 40 | 20 |
| Conductive carbon black | 2 | 2 | 2 | 22 |
| Method of forming oxide film | Ultraviolet ray, 5 minutes | Ultraviolet ray, 5 minutes | Ultraviolet ray, 5 minutes | Ultraviolet ray, 5 minutes |
| Dielectric loss tangent | 2.1 | 2.8 | 1.7 | 0.50 |
| Electric resistance of roller (logR500) | 5.9 | 5.9 | 5.9 | 5.8 |
| Electric resistance of roller (logR100) | 6.1 | 6.1 | 6.1 | 6.0 |

TABLE 1-continued

| | Example 1 | Example 2 | Comparison example 1 | Comparison example 2 |
|---|---|---|---|---|
| Conductivity | Ion | Ion | Ion | Ion |
| Charged amount (μC/g) | −7.0 | −3.5 | −18.0 | −27.5 |
| Cleaning performance by blade | ○ | ◎ | Δ | X |

The following components were used for the conductive rubber roller of each of the examples and the comparison examples:

Epichlorohydrin rubber (GECO): "Epichlomer CG102" produced by Daiso Inc. The epichlorohydrin rubber is a copolymerizate of 56 mol % of ethylene oxide (EO), 40 mol % of epichlorohydrin (EP), and 4 mol % of allyl glycidyl ether (AGE))

Powder sulfur (vulcanizing agent).

Ethylene thiourea (vulcanizing agent): "Accel 22-S" produced by Kawaguchi Kagaku Inc.

Hydrotalcite (acid-accepting agent): "DHT-4A-2" produced by Kyowa Kagaku Kogyo Inc.

Hydrous aluminum silicate compound: hard clay "Crown" ($Al_2O_3.2SiO_2.2H_2O$) produced by Southeastern Clay Inc.

Conductive carbon black: "Sheast 3" produced by Tokai Carbon Inc.

Calcium carbonate: "Super S" produced by Maruo Calcium Inc.

Measurement of Electric Resistance of Rubber Roller

Figure 5:
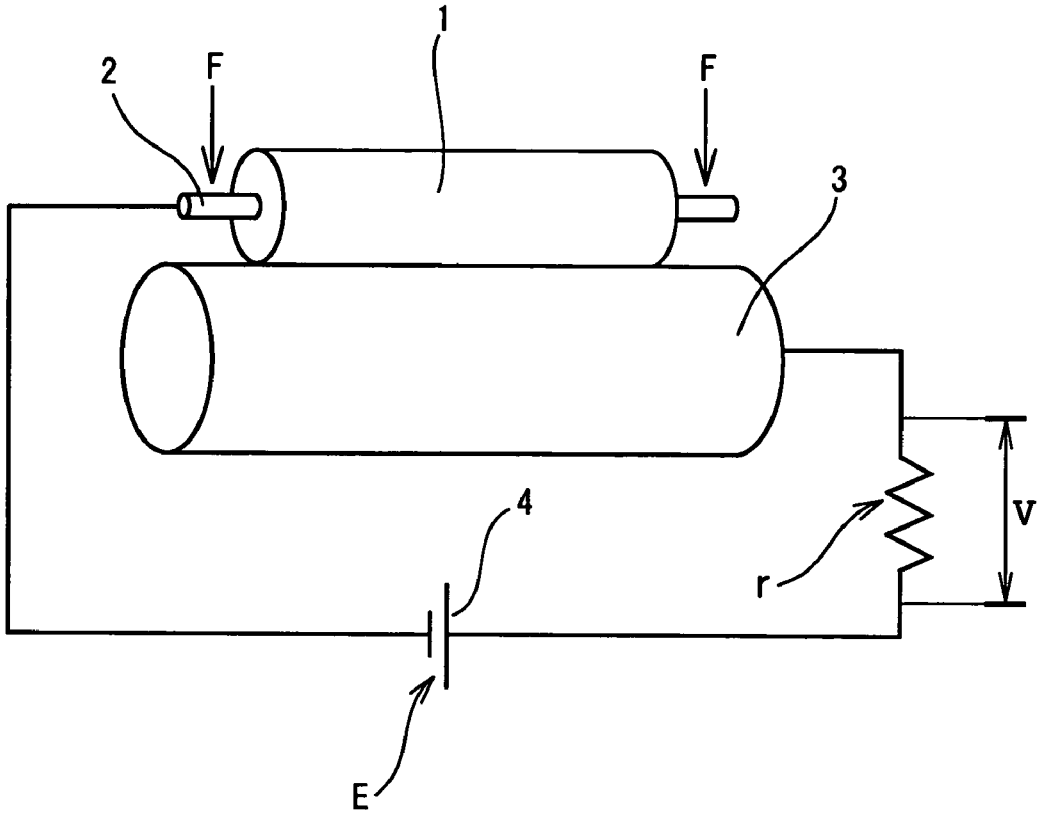
FIG. 5 shows a method of the present invention for measuring the electric resistance of the conductive rubber member.

To measure the electric resistance of the conductive rubber member 10, as shown in FIG. 5, the rubber layer 1 through which the core metal 2 was inserted was mounted on an aluminum drum 3, with the rubber layer 1 in contact with the aluminum drum 3. One end of a conductor having an internal electric resistance of r (100 Ω) was connected to the positive side of a power source 4. The other end of the conductor was connected to one end surface of the aluminum drum 3. One end of another conductor was connected to the negative side of the power source 4. The other end of the conductor was connected was connected to one end surface of the conductive rubber roller 10.

A voltage V applied to the internal electric resistance r of the conductor was detected. Supposing that a voltage applied to the apparatus is E, the electric resistance R of the rubber roller 10 is: $R=r\times E/(V-r)$. Because the term of −r is regarded as being extremely small, $R=r\times E/V$. A load F of 500 g was applied to both ends of the core metal 2. A voltage E of 500V or 100V was applied to the conductive rubber member 10, while it was being rotated at 30 rpm. The detected voltage V was measured at 100 times during four seconds. The electric resistance R was computed by using the above equation. The measurement was conducted at a constant temperature of 23° C. and a constant humidity of 55%.

Measurement of Dielectric Loss Tangent of Rubber Roller

Figure 6:
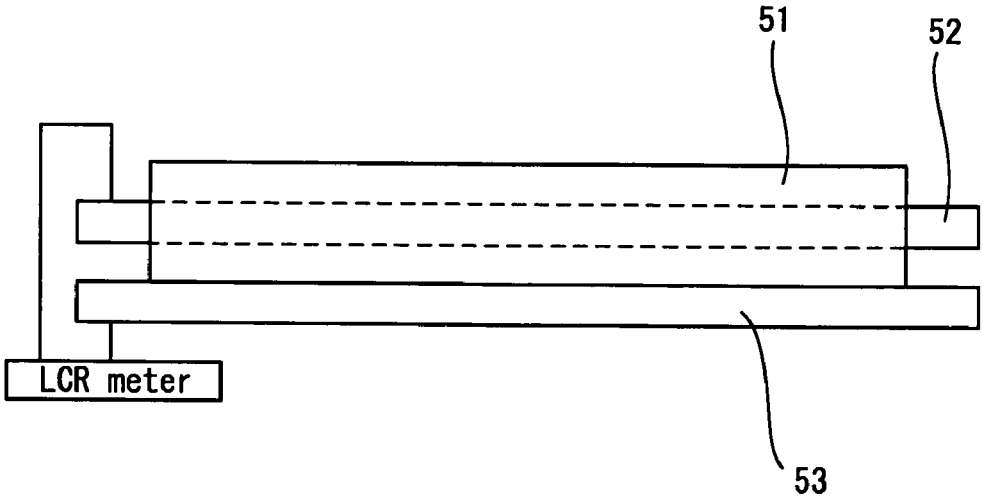
FIG. 6 shows a method of the present invention for measuring the dielectric loss tangent of the conductive rubber member.

As shown in FIG. 6, an alternating voltage of 5V with a frequency of 100 Hz was applied to a rubber roller 51, with a shaft 52 and a metal plate 53, serving as an electrode respectively, on which a rubber roll 51 was placed. An R (electric resistance) component and a C (capacitor) component were measured separately by an LCR meter (AG-4311B, manufactured by Ando Denki) at a temperature of 23° C. to 24° C. (room temperature). The dielectric loss tangent, the impedance, and the phase angle were computed from the value of R and C by using the following equation.

$$\text{Dielectric loss tangent } (\tan\delta)=G/\omega C \quad G=1/R$$

The dielectric loss tangent is found as G/ωC, when the electrical characteristic of one rubber roller is modeled as a parallel equivalent circuit of the electric resistance component of the rubber roller and that of the capacitor component of the rubber roller. A measurement of the dielectric loss tangent of a cleaning blade was conducted under the same condition described above, that is, an alternating voltage of 5V with a frequency of 100 Hz was applied to a surface of a metal core cleaning blade on which a cleaning blade was sticked.

Evaluation of Property of Rubber Roller in Destaticizing Adhered Toner

To examine to what extent charged toner which adhered to the conductive rubber member of the present invention is destaticized, the following test was conducted. The rubber roller of each of the examples and the comparison examples was mounted as a charging roller on a laser printer (LP2000C produced by Seiko Epson Inc.) commercially available. After 5% printing was performed on 50 sheets of paper, a 25% halftone image was printed thereon. Thereafter the charged amount of the toner which adhered to the charging roller was measured to obtain the evaluation parameter.

More specifically, after the halftone image was formed, the charging roller was removed from the laser printer. Thereafter a suction-type machine ("METER Model 210HS-2" manufactured by Trek Inc.) for measuring the charged amount of the toner was set above the charging roller to suck the toner. The charged amount (μC) of the toner and the weight (g) thereof were measured after elapse of five minutes. The amount of static electricity per weight was computed as the charged amount (μC/g). That is, Charged amount (μC/g)=Charged amount (μC)/weight(g) of toner.

Cleaning Performance by Blade

The rubber roller of each of the examples and the comparison examples was mounted as the charging roller on the laser printer (LP2000C produced by Seiko Epson Inc.) commercially available. After 5% printing was performed on 50 sheets of paper, a 25% halftone image was printed thereon. Thereafter the charging roller was removed from the laser printer. A blade made of urethane was brought into contact with the charging roller under a pressure of 1.5 $g/cm^2$ to scrape toner which adhered to the surface of the charging roller. To what extent the toner remained on the surface of the charging roller was evaluated visually. The charging roller on which the toner did not remain was marked by ◎. The charging roller on which a slight amount of the toner remained was marked by ○. The charging roller on which the toner remained was marked by Δ. The charging roller on which much toner remained was marked by X.

As apparent from table 1, the conductive rubber member of the example 1 containing a hydrous aluminum silicate compound (hard clay) and calcium carbonate as the dielectric loss tangent-adjusting filler had a dielectric loss tangent of 2.1. The conductive rubber member of the example 2 containing the hydrous aluminum silicate compound as the dielectric loss tangent-adjusting filler had a dielectric loss tangent of 2.8. The conductive rubber member of the comparison example 1 not containing the dielectric loss tangent-adjusting filler had a dielectric loss tangent of 1.7 which is less than 2.0. The conductive rubber member of the comparison example 2 not containing the dielectric loss tangent-adjusting filler had a dielectric loss tangent of 0.50. The charged amount of toner which adhered to the conductive rubber roller of the example 1 was −7.0 μC/g. The charged amount of toner which adhered to the conductive rubber roller of the example 2 was −3.5 μC/g. Thus in the examples 1 and 2, the charged amount of the toner was small. On the other hand, the charged amount of toner which adhered to the conductive rubber roller of the comparison example 1 was −18.0 μC/g. The charged amount of toner which adhered to the conductive rubber roller of the comparison example 2 was −27.5 μC/g. Thus in the conductive rubber member of the comparison examples 1 and 2, the charged amount was not reduced much. That is, in the conductive rubber member of the examples 1 and 2, the charged amount can be reduced to 1/7.9 to 1/2.6. It was confirmed that the conductive rubber member of the examples 1 and 2 destaticized the toner effectively. Therefore the destaticized toner can be easily removed with the blade or the like.

The toner collected in the above-described test of "cleaning performance by blade" conducted for the conductive rubber roller of the examples 1 and 2 was used by reloading it in a cartridge. As a result, preferable images were obtained. This indicates that deterioration of the toner was suppressed sufficiently in the cleaning process.

When the conductive rubber roller of each of the examples 1 and 2 was used as charging rollers, preferable chargeability was obtained.

What is claimed is:

1. A conductive rubber member having a rubber layer, disposed in an outermost layer thereof, composed of a rubber composition containing an ionic-conductive rubber, said rubber composition further containing a filler for adjusting a dielectric loss tangent of said conductive rubber member to not less than 2.0 nor more than 5.0, when an alternating voltage of 5V with a frequency of 100 Hz is applied to said conductive rubber member.

2. The conductive rubber member according to claim 1, wherein as said filler, 5 to 100 parts by mass of a hydrous aluminum silicate compound is present per 100 parts by mass of a rubber component.

3. The conductive rubber member according to claim 1, wherein an oxide film is formed on a surface of said rubber layer.

4. The conductive rubber member according to claim 1, wherein when an electric resistance of said conductive rubber roller is R100 when a voltage of 100V is applied thereto, and is R500 when a voltage of 500V is applied thereto, the following relationship is established:

$$\log R100 - \log R500 < 0.5$$

5. The conductive rubber member, according to claim 1, which is mounted on an image-forming apparatus as a cleaning roller for cleaning at least one portion of toner, an external additive added to said toner, and paper powder remaining on a photoreceptor and other members of said image-forming apparatus.

6. The conductive rubber member, according to claim 1, which is mounted on an image-forming apparatus as a roller to which at least one portion of toner, an external additive added to said toner, and paper powder remaining on a photoreceptor are adhered and which has a function of destaticizing said toner, said external additive or said paper powder.

7. The cleaning apparatus comprising a roller-shaped conductive rubber member according to claim 1 and a blade which is maintained in contact with a surface of said conductive rubber member.

8. An image-forming apparatus, in which a conductive rubber member according to claim 1 is mounted as a cleaning roller or a charging roller having a cleaning function.

* * * * *